United States Patent [19]

Steigman

[11] Patent Number: 4,464,904

[45] Date of Patent: Aug. 14, 1984

[54] PROCESS FOR THE TRANSFER OF REFRIGERATION

[75] Inventor: Frederic N. Steigman, Ossining, N.Y.

[73] Assignee: Union Carbide Corporation, Danbury, Conn.

[21] Appl. No.: 496,080

[22] Filed: May 19, 1983

[51] Int. Cl.[3] ..... F17C 7/02

[52] U.S. Cl. ..... 62/52; 62/114; 62/434; 252/70; 252/71

[58] Field of Search ..... 62/434, 514 R, 52, 114; 252/67, 70, 71

[56] References Cited

U.S. PATENT DOCUMENTS

| | | | |
|---|---|---|---|
| 3,535,210 | 10/1970 | Linde et al. | 62/333 |
| 4,122,684 | 10/1978 | Clarkson et al. | 62/54 |
| 4,237,700 | 12/1980 | Rothchild | 62/514 R |

*Primary Examiner*—Ronald C. Capossela

*Attorney, Agent, or Firm*—Saul R. Bresch

[57] ABSTRACT

Process for the transfer of refrigeration from a cryogen to a heat load via an intermediary fluid utilizing heat exchangers wherein the intermediary fluid is maintained together with an inert gas in a closed loop, which has a defined volume.

1 Claim, 1 Drawing Figure

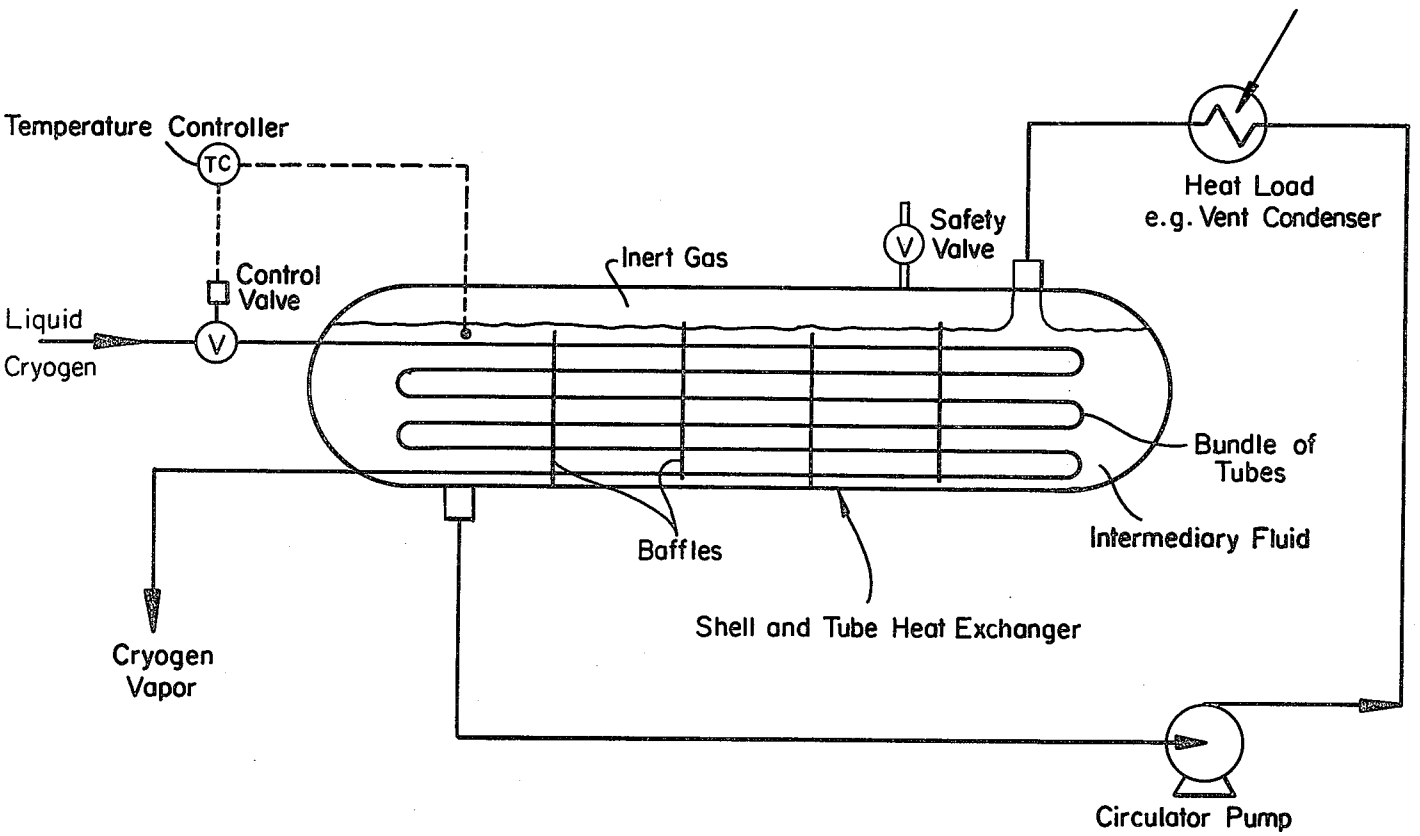
Heat Load
e.g. Vent Condenser
Safety
Valve
V
Inert Gas
Temperature Controller
TC
Control
Valve
V
Liquid
Cryogen
Bundle of
Tubes
Intermediary Fluid
Baffles
Shell and Tube Heat Exchanger
Cryogen
Vapor
Circulator Pump

PROCESS FOR THE TRANSFER OF REFRIGERATION

DESCRIPTION

1. Technical Field

This invention relates to a process for the transfer of refrigeration from a liquid cryogen to a heat load through an intermediary fluid.

2. Background Art

The use of an intermediary fluid to carry refrigeration from a liquid cryogen to a use point has certain advantages. When liquid nitrogen, for example, is to be used as the source of refrigeration, but the specific application does not require low temperatures, e.g., below minus 150° F., the use of an intermediate fluid eliminates the need to run cryogenic piping between the liquid nitrogen storage tank and the place where the refrigeration is desired. Further, the use of an intermediate fluid in a nitrogen-refrigerated system permits the application of refrigeration at easily controlled temperatures above the minus 320° F. temperature of liquid nitrogen, and does so without deliberately adding heat to the refrigerant, thus increasing the general applicability and efficiency of liquid nitrogen in non-contact refrigeration schemes.

The question has arisen, in view of the foregoing advantages, as to whether an intermediary fluid can be successfully used to reduce storage tank vent emissions of noxious gases during tank breathing and filling. Current non-cryogenic technologies for vent emissions reduction make use of mechanically refrigerated vent condensers, activated carbon adsorbers or vent gas compression/storage techniques. Mechanically refrigerated vent condensers involve a significantly greater capital outlay and are prone to mechanical reliability problems. Mechanical refrigeration systems become increasingly elaborate and subject to mechanical failure when working fluid temperatures fall below the minus 70° F. to minus 100° F. range. Regenerable adsorption systems are expensive and complicated and, if the vented vapors are to be recovered in the liquid form, require a source of steam or hot nitrogen for regeneration and mechanical refrigeration for vapor condensation. Compressor systems compress the vent gas into a separate storage vessel during venting and let the vent gas flow back to the main storage tanks during breathing. These systems are estimated to be four to six times as expensive as liquid nitrogen condensation systems would be and are incapable of handling the gas flows which result when the storage tanks are filled.

Two cryogenic techniques have also been considered for vent emissions reduction, but raise as many problems as the non-cryogenic methods. Supplying liquid nitrogen directly to the tube side of a shell and tube vent condenser risks a buildup of frozen vent gas, which could rapidly choke off the vent. The spraying of liquid nitrogen into the vent pipe or tank headspace to maintain the tank pressure below the relief valve setting can cause large and rapid tank pressure fluctuations, making tank pressure difficult to control, and this technique does not permit nitrogen vapor to be recovered for other process uses.

In view of the deficiencies of the non-cryogenic and cryogenic techniques, the use of an intermediary fluid chilled by liquid nitrogen appears to be a most practical way to accomplish tank vent condensation since the use of relatively warm refrigeration eliminates potential tank vent ice-plugging and the avoidance of direct-contact heat exchange prevents the anticipated tank pressure fluctuations from interfering with the tank blanketing, relief, and venting systems, and with the pressure-controlled vent condensation system itself. These same advantages indicate applications in crystallization and warehouse cooling.

The problem is to translate what appears to be practical into a process, which will, in fact, extract the maximum refrigeration from the liquid cryogen while minimizing the amount of cryogen used; minimize intermediary fluid losses; essentially avoid freeze-up at the use point; control pressure fluctuations in the system; be economical, both in operating and capital costs; and be simple insofar as the working parts needed to effect the process are concerned.

Disclosure of the Invention

An object of this invention, therefore, is to provide a process for the transfer of refrigeration utilizing an intermediary fluid in such a way as to avoid material losses, freeze-ups, and pressure fluctuations.

Other objects and advantages will become apparent hereinafter.

According to the present invention, an improvement has been discovered in a process for the transfer of refrigeration from a source of liquid cryogen to a heat load via an intermediary fluid comprising the following steps:

(a) introducing the liquid cryogen from its source into the tube side of a shell and tube heat exchanger;

(b) passing the intermediary fluid through the shell side of the shell and tube heat exchanger referred to in step (a); and (c) passing the intermediary fluid from step (b) to heat exchange means, which is in a heat transfer relationship with the heat load.

The improvement comprises:

(i) maintaining the intermediary fluid in a closed loop, a portion of which loop is the shell side of the shell and tube heat exchanger referred to in step (a) and another portion of which loop is a passage in the heat exchange means referred to in step (c); and (ii) circulating the intermediary fluid through the closed loop wherein (A) there is provided in the closed loop, in addition to the intermediary fluid, a gas, which is essentially inert to, and essentially insoluble in, the intermediary fluid, said gas being present in such an amount that the pressure in the closed loop can be maintained in the range of about 1 to about 2 atmospheres at the operating temperature thereof;

(B) the intermediary fluid is a liquid of such viscosity that it is capable of being circulated through the closed loop at the operating temperature and pressure thereof; and (C) the closed loop has a total volume calculated in accordance with the following formula:

$$\text{volume} = B\left(1 - \frac{CA}{D}\right) / [C(1 - A)]$$

wherein:

-continued $$A = \frac{E - F}{G\frac{H}{J}\left(1 - \frac{F}{KHD}\right)}$$

B=mass of intermediary fluid in the closed loop
C=density of the intermediary fluid at temperature J
D=density of the intermediary fluid at temperature H
E=maximum design pressure for the closed loop within the range set forth in paragraph (A) above
F=vapor pressure of the intermediary fluid at temperature H
G=desired closed loop pressure at temperature J within the range set forth in paragraph (A) above
H=maximum intermediary fluid temperature
J=minimum operating temperature for intermediary fluid
K=gas constant for vapor of the intermediary fluid, and
all temperatures and pressures are in absolute units.

This formula allows both the amount (or mass) of intermediary fluid in the closed loop and the maximum and minimum closed loop pressures to be selected. The calculated volume includes all internal volume available to the intermediary fluid and/or the inert gas in the closed loop including the shell side of the shell and tube heat exchanger, the portion of the loop where the heat transfer at the heat load takes place, e.g., the vent condenser, and any interconnecting piping. Any volume in excess of the volume required for the intermediary fluid is gas volume and may be contained in the shell side of a specially designed shell and tube heat exchanger or in a separate expansion tank elsewhere in the closed loop.

BRIEF DESCRIPTION OF THE DRAWING

The sole FIGURE is a schematic drawing of an embodiment of the apparatus in which the process can be carried out. Significant features are labeled in accordance with the following description.

DETAILED DESCRIPTION

With the possible exception of the heat exchanger mentioned in step (a) above, the apparatus used to carry out subject process is conventional off-the-shelf apparatus constructed of conventional materials. Typically, the apparatus in a system, for example, for the condensation of noxious vent gases, is as follows: a storage tank for liquid cryogen, which, as a matter of choice, is liquid nitrogen, although other liquid cryogens can, of course, be utilized; a shell and tube heat exchanger located as close as possible to the liquid cryogen storage tank to minimize the amount of insulated cryogenic piping, the liquid nitrogen passing through the tube side of the heat exchanger and the intermediary fluid passing through the shell side of the heat exchanger (the heat exchanger has a relief valve and may have an expansion tank); a circulator pump for pumping the intermediary fluid through the system; heat exchange means, which can be a shell and tube condenser at the vent of the storage or holding tank for the liquid or gas from which the noxious vapors are being vented, or some other form of heat exchanger; the storage or holding tank together with a vent; and an insulated closed loop piping system through which the intermediary fluid is circulated from the first heat exchanger where it is cooled to the second heat exchanger where it condenses the noxious gas. Means for purging the closed loop prior to initial fill and for controlling the temperature of the intermediary fluid are provided.

The shell and tube heat exchanger in which the intermediary fluid is cooled is preferably designed in the horizontal mode with a bundle of spaced tubes in the lower portion of the shell, segmented baffles for the intermediary fluid on the shell side, a single shell pass, and multiple tube passes. The number of tube passes is not critical to the process. The tubes in the bundle are preferably connected in series so that there is no liquid nitrogen header, i.e., no heat exchanger outer surface is at liquid nitrogen temperature. This results in reduced insulation requirements. When there is relatively little circuit volume external to the heat exchanger, i.e., no expansion tank, this heat exchanger design lends itself to allowing sufficient shell side volume for the inert gas. The bundle of tubes is located below the level of the intermediary fluid in the fluid filled lower portion of the exchanger and baffles direct the flow of intermediary fluid over the tubes. The headspace inert gas, usually nitrogen, is free to communicate among the various partitions of the shell, residing in the upper portion of the shell. Alternatively, the gas may be contained in an expansion tank, which is made a part of the closed loop or the gas can also be present in the loop such that there will be an upper gas phase and a lower liquid phase provided that, in the latter case, the gas does not interfere with the operation of the heat exchange means or the circulating pump.

A temperature control means is provided which admits liquid cryogen to the tubes of the shell and tube heat exchanger at a sufficient flow rate to maintain the intermediary fluid at a temperature appropriate to the particular refrigeration application.

The closed loop is charged at about one atmosphere by adding to the loop the correct amount of intermediary fluid and then starting the circulation pump and adjusting the set point of the temperature control means to the minimum operating temperature. Then, while the intermediary fluid is being cooled and circulated, moist air in the loop is purged out and replaced by inert gas after which the loop is sealed. The sealed circuit is equipped with pressure relieving safety devices.

Two advantages of subject process are found at the shell and tube heat exchanger, which is used for cooling the intermediary fluid, one being that the liquid nitrogen becomes cool nitrogen vapor and the cool gas can be used in other processes and the other being that from this central source, intermediary fluid can be dispatched to several use points as long as the closed loop or loops are maintained intact.

It is recognized that there will tend to be a buildup of frozen intermediary fluid on those portions of the shell and tube heat exchanger cryogen tubing, the temperature of which portions are below the intermediary fluid melting point. Rather than avoid the buildup, it is accommodated by placing the intermediary fluid on the shell side where there is more room available and also by spacing the tubes so as to prevent ice buildups on adjacent tubes from coalescing and blocking off shell side flow. The fairly large contained gas volume; the normally extensive amount of heat transfer area; and the minimum spacing between tubes used to accommodate buildups could result in the need for large heat exchangers, however. To keep the size of the heat exchanger to a minimum, the area utilization efficiency of the tubes becomes important. An equilateral triangle tubing configuration is suggested as the most efficient packing geometry. With the tube centerlines at the points of adjacent equilateral triangles, the packing factor, i.e., the ratio of total tube cross section to total tube bundle cross section, is given as follows:

$$\text{packing factor} = 0.9069(d/L)^2$$

wherein:

d=tube outer diameter

L=length of triangle side.

A spacing of $2\frac{3}{4}$ inches when used with nominal $\frac{3}{4}$ inch tubing will provide a packing factor of about 10 percent. This packing factor is, for example, adequate to compensate for the expected buildup of frozen intermediary fluid in ethanol/liquid nitrogen systems operating at minus 70° F. The appropriate packing factor will depend upon the minimum operating temperature and the intermediary fluid and cryogen used and may be determined analytically or by laboratory testing.

The equilateral triangle configuration simply means that the parallel tubes of the shell and tube heat exchanger are arranged such that their central lines (or central axes) appear in cross section to coincide with the vertices of contiguous, equilateral triangles. As noted, this configuration minimizes heat exchanger volume and, therefore, cost while maintaining adequate flow area for the circulating intermediary fluid between and among the tubes possibly laden with frozen intermediary fluid. On a cross-sectional basis, the tubes preferably take up an area of about 5 to about 15 percent of the overall cross-sectional area of the tubing bundle, the cross-section being taken in the vertical plane, and the balance of the cross-sectional area is, aside from structure, filled with intermediary fluid and gas, although the gas, as noted may be in an expansion tank elsewhere in the closed system.

As noted, the gas is essentially inert to, and insoluble in, the intermediary fluid. It is also dry, i.e., essentially devoid of water, and is compressible. While a wide variety of inert gases can obviously be used, nitrogen is the gas of choice. The gas minimizes temperature induced pressure variations in the closed loop. In fact, the gas makes it practical for the loop to be sealed thus preventing moisture infiltration and the loss of the intermediary fluid either in liquid or vapor form.

Typically, the closed loop contains about 50 to about 60 percent by volume intermediary fluid, in liquid form, and about 40 to about 50 percent by volume of an inert gas, in vapor form.

Selection criteria for the intermediary fluid are that it have a relatively high heat capacity and low melting point, that it be a liquid at operating temperatures and pressures, and that it have such a viscosity that the fluid is capable of being pumped at the operating temperatures and pressures of the process. A preferred example of a working fluid is ethanol, which has a specific heat of 0.48 BTU/Pound/°F. at minus 100° F.; a viscosity of 15 centipoises at minus 100° F.; and a normal melting point of minus 173° F. The closed loop avoids the loss of volatile intermediary fluid and the need for replacement, and the infiltration of the closed loop by moisture, which could contaminate the fluid or plug the system with ice. In general, the closed loop will undergo large temperature variations, typically from minus 100° F. in operation to plus 100° F. when turned off and warmed up. Depending on the thermal expansion characteristics of the intermediary fluid, large pressure fluctuations (both pressure and vacuum) can be induced. A nominally sealed loop, therefore, runs the risk of pulling in moist air when under vacuum and of bulging or bursting when overheated. To avoid these risks, the closed loop is preferably sealed in the chilled condition at atmospheric pressure with a precalculated amount of intermediary fluid and a precalculated amount of inert gas. The loop will then never be under any appreciable vacuum when chilled. The gas sealed in the loop acts as a compressible volume, which, upon warming up, allows the intermediary fluid to expand without building up excessive pressure. The amount of gas depends on the characteristics of the intermediary fluid and the inert gas, cold and hot temperature extremes, and the upper pressure limit. Using this approach, the design upper pressure limit may be kept below that at which the loop requires pressure vessel certification. It is found that, with nitrogen/ethanol systems operating within the temperature range of minus 100° F. to plus 100° F., a volumetric split of approximately 50/50 will generally preclude the pressure from exceeding 15 psig, the value at which certification may be required. In any case, appropriate pressure relief devices should be provided to assure safe operation.

The invention is illustrated by the following example.

EXAMPLE

Subject process is carried out to achieve the condensation of noxious vapors emanating from a holding tank containing dimethylsulfide.

A list of the main items of equipment used in the example follows:

1. holding tank with vent and vent condenser;
2. a horizontal, cylindrical shell and tube heat exchanger with gas volume on the shell side;
3. liquid nitrogen storage tank connected to tube side of heat exchanger with means for recovery of cold nitrogen vapor for use in another process;
4. closed loop connecting shell side and vent condenser through interconnecting tubing, the closed loop being prepared as noted above and having a circulator pump and a relief valve; and
5. temperature controller for providing liquid cryogen to shell and tube heat exchanger.

The liquid cryogen is liquid nitrogen; the intermediary fluid is ethanol; and the inert gas for the closed loop is nitrogen.

The materials of which the equipment is made are as follows: brass, copper, and AISI 300 series austenitic stainless steel.

The following design conditions also exist:

1. The total length of the copper tubing (nominal $\frac{3}{4}$ inch, $\frac{7}{8}$ inch outside diameter) on the tube side of the shell and tube heat exchanger is 500 feet as determined by conventional methods for calculating required heat transfer area;
2. The length of the bundle of tubes is 8.5 feet and lies in the lower portion of the shell and tube heat exchanger, which has a length of 9.0 feet.
3. The volume of the closed loop external to the heat exchanger is approximated by 800 feet of nominal $\frac{3}{4}$ inch copper tubing with an internal volume of 2.5 cubic feet.
4. The permissible bundle packing factor is equal to 0.10.
5. There is sufficient ethanol in the closed loop to just cover the tubing bundle and fill the closed loop at one atmosphere and minus 70° F.

6. There is sufficient nitrogen to fill the remaining heat exchange volume at the same pressure and temperature.

7. The maximum design pressure and temperature are 27.2 psia and 100° F. respectively.

Given the above, the specification of the sealed loop are completed as follows:

(a) The number of tubes in the bundle=500/8.5=59.

(b) Cross-sectional area per tube=0.601 square inch.

(c) Total tube cross-sectional area for the bundle=35.46 square inches.

(d) Total bundle cross-sectional area=35.46/0.10=354.6 square inches (note: includes tube cross-sectional area plus open cross-sectional area within bundle).

(e) Bundle cross-sectional area available for ethanol=354.6 square inches minus 35.46 square inches=319.1 square inches.

(f) Ethanol volume at one atmosphere and minus 70° F. including ethanol within tubing bundle plus ethanol elsewhere in heat exchanger plus ethanol external to heat exchanger=18.84 cubic feet plus 1.23 cubic feet plus 2.5 cubic feet=22.57 cubic feet.

(g) Total volume of closed loop =

$$B\left(1-\frac{CA}{D}\right)/[C(1-A)] = 44.15 \text{ cubic feet}$$

$$A=\frac{E-F}{G\frac{H}{J}\left(1-\frac{F}{KHD}\right)} = 1.152$$

B=22.57 cubic feet times 56.2 pounds per cubic feet=1268 pounds

C=56.2 pounds per cubic foot

D=49.9 pounds per cubic foot

E=27.2 psia

F=2.9 psia

G=14.7 psia

H=560 R

J=390 R

K=15.61 foot pounds/pound−R.

(h) The volume of the shell and tube heat exchanger is equal to the closed loop volume plus the tube bundle volume minus the closed loop volume external to the heat exchanger=43.74 cubic feet.

(i) The cross-section of the shell and tube heat exchanger is its volume divided by its length=4.86 square feet.

(j) The theoretical shell and tube heat exchanger diameter=2.49 feet.

Using the equipment together with the steps and conditions as described above, and applying the formula, it is found that there are essentially no material losses, freeze-ups, or undesirable pressure fluctuations. It is observed that a slightly larger shell diameter may be used when it is desired to select a shell from among conventional sizes. This will result in a slightly lower maximum pressure.

I claim:

1. In a process for the transfer of refrigeration from a source of liquid cryogen to a heat load via an intermediary fluid comprising the following steps:

(a) introducing the liquid cryogen from its source into the tube side of a shell and tube heat exchanger;

(b) passing the intermediary fluid through the shell side of the shell and tube heat exchanger referred to in step (a); and (c) passing the intermediary fluid from step (b) to heat exchange means, which is in a heat transfer relationship with the heat load, the improvement comprising:

(i) maintaining the intermediary fluid in a closed loop, a portion of which loop is the shell side of the shell and tube heat exchanger referred to in step (a) and another portion of which loop is a passage in the heat exchange means referred to in step (c); and (ii) circulating the intermediary fluid through the closed loop wherein (A) there is provided in the closed loop, in addition to the intermediary fluid, a gas, which is essentially inert to, and essentially insoluble in, the intermediary fluid, said gas being present in such an amount that the pressure in the closed loop can be maintained in the range of about 1 to about 2 atmospheres at the operating temperature thereof;

(B) the intermediary fluid is a liquid of such viscosity that it is capable of being circulated through the closed loop at the operating temperature and pressure thereof; and (C) the closed loop has a total volume calculated in accordance with the following formula:

$$\text{volume} = B\left(1-\frac{CA}{D}\right)/[C(1-A)]$$

wherein:

$$A=\frac{E-F}{G\frac{H}{J}\left(1-\frac{F}{KHD}\right)}$$

B=mass of intermediary fluid in the closed loop

C=density of the intermediary fluid at temperature J

D=density of the intermediary fluid at temperature H

E=maximum design pressure for the closed loop within the range set forth in paragraph (A) above F=vapor pressure of the intermediary fluid at temperature H G=desired closed loop pressure at temperature J within the range set forth in paragraph (A) above H=maximum intermediary fluid temperature J=minimum operating temperature for intermediary fluid K=gas constant for vapor of the intermediary fluid, and all temperatures and pressures are in absolute units.

* * * * *